US010995971B2

(12) United States Patent
Zhou

(10) Patent No.: US 10,995,971 B2
(45) Date of Patent: May 4, 2021

(54) ENERGY-SAVING AND ENVIRONMENT-FRIENDLY DOUBLE-ROW AIR DUCT HEATER

(71) Applicant: Ningbo Baogong Electrical Appliance Co., Ltd., Zhejiang (CN)

(72) Inventor: Junshu Zhou, Zhejiang (CN)

( * ) Notice: Subject to any disclaimer, the term of this patent is extended or adjusted under 35 U.S.C. 154(b) by 310 days.

(21) Appl. No.: 16/236,649

(22) Filed: Dec. 31, 2018

(65) Prior Publication Data

US 2020/0173687 A1 Jun. 4, 2020

(30) Foreign Application Priority Data

Nov. 29, 2018 (CN) ..... 201811439457.7

(51) Int. Cl.
*F24H 3/04* (2006.01)

(52) U.S. Cl.
CPC ..... *F24H 3/0417* (2013.01)

(58) Field of Classification Search
None
See application file for complete search history.

(56) References Cited

U.S. PATENT DOCUMENTS 1,553,421 A * 9/1925 Woodson ..... F24H 3/0417 392/379
1,620,767 A * 3/1927 Johnson ..... F24H 3/0411 392/367
1,942,758 A * 1/1934 Jessup ..... F24H 3/0417 392/376
1,982,190 A * 11/1934 Ball ..... F24H 3/0417 392/365
1,982,382 A * 11/1934 Gundelfinger ..... F24H 3/0417 392/361
1,986,350 A * 1/1935 Logan ..... F24H 3/0417 392/376
1,998,670 A * 4/1935 Goshorn ..... F24H 3/0417 392/375
2,153,239 A * 4/1939 Curci ..... F24H 3/0417 392/383
2,232,492 A * 2/1941 Steingruber ..... F24H 3/002 392/376
2,429,733 A * 10/1947 Trent ..... F24H 3/0417 392/366
2,562,436 A * 7/1951 Pass ..... F24H 3/0417 392/376
2,565,769 A * 8/1951 Hatker ..... F24H 3/0411 219/217
2,988,626 A * 6/1961 Buttner ..... F24H 3/0411 392/353

(Continued)

*Primary Examiner* — Thor S Campbell

(57) ABSTRACT

Disclosed is an energy-saving and environment-friendly double-row air duct heater, including a bottom plate and a shell. A motor and fan blades are arranged on one end in the shell. The upper part of the shell is provided with a control device. A heating component is arranged on the other end in the shell. An air inlet is formed at the rear end of the shell, and an air outlet is formed at the front end of the shell. The heating component includes an air volume drainage device. Two groups of electric heating pipes are arranged on both sides of the air volume drainage device. Each group of electric heating pipes is composed of a plurality of vertically arranged electric heating pipes. An air guiding passage is formed between two adjacent electric heating pipes.

7 Claims, 6 Drawing Sheets

(56) References Cited

U.S. PATENT DOCUMENTS 3,095,497 A * 6/1963 Martin ..... F24H 3/0405 392/360
3,105,892 A * 10/1963 Knapp ..... F24H 1/00 392/368
3,139,516 A * 6/1964 Boecher ..... F24H 3/0417 392/358
3,176,117 A * 3/1965 Knoll ..... F24H 3/0411 392/360
3,612,173 A * 10/1971 Goyal ..... F24H 3/0417 165/122
3,627,038 A * 12/1971 Wilkins ..... F24H 9/2064 165/126
3,627,985 A * 12/1971 Hostetler ..... A01K 31/20 392/367
4,398,082 A * 8/1983 Johannsen ..... F24H 3/0417 338/287
4,518,847 A * 5/1985 Horst, Sr. ..... F24H 9/2071 126/101
4,737,616 A * 4/1988 Wen-Ying ..... F24H 3/0417 219/472
5,245,692 A * 9/1993 Kawai ..... F24H 3/0417 165/125
5,513,296 A * 4/1996 Goldstein ..... F24H 3/0417 392/365
5,655,055 A * 8/1997 Goldstein ..... F24H 3/0417 392/367
5,721,804 A * 2/1998 Greene, III ..... F24H 3/004 126/101
7,190,887 B1 * 3/2007 Compton ..... F24H 3/0417 219/533
2008/0083745 A1 * 4/2008 Hess ..... H05B 3/48 219/544
2008/0181589 A1 * 7/2008 Dean ..... F24H 3/0417 392/373
2008/0193111 A1 * 8/2008 Seutter ..... F24H 3/0417 392/381
2008/0240689 A1 * 10/2008 Coke ..... F24H 3/0417 392/367
2009/0003808 A1 * 1/2009 Brooke ..... H05B 3/008 392/407
2013/0216213 A1 * 8/2013 Thomas ..... F24H 9/0063 392/465
2014/0161426 A1 * 6/2014 Crowe ..... F24H 3/0417 392/367
2015/0159891 A1 * 6/2015 Chan ..... F24F 7/007 165/59

* cited by examiner

ENERGY-SAVING AND ENVIRONMENT-FRIENDLY DOUBLE-ROW AIR DUCT HEATER

CROSS-REFERENCE TO RELATED APPLICATIONS

This application claims the benefit of priority from Chinese Patent Application No. 201811439457.7, filed on Nov. 29, 2018. The content of the aforementioned application, including any intervening amendments thereto, is incorporated herein by reference in its entirety.

TECHNICAL FIELD

The present invention relates to the technical field of heaters, and in particular to an energy-saving and environment-friendly double-row air duct heater.

BACKGROUND

At present, the existing axial-flow electric heater mainly directly blows a heating body to produce forced convection for space heating. However, due to the limitation of blade structure, there is no wind in the middle of the blade. When the blade rotates, the middle of the blade is at negative pressure under the influence of centrifugal force, resulting in that there is no wind in the middle or the wind direction is opposite. The wind blowing through the surface of an electric heating pipe of the heater is not uniform, resulting in high temperature in some electric heating pipe positions and low temperature in some other positions, poor heating effect and low thermal efficiency.

SUMMARY

The purpose of the present invention is to provide an energy-saving and environment-friendly double-row air duct heater, so as to effectively solve the thermal efficiency problem of space heating and increase the thermal efficiency. The temperature of the surfaces of the electric heating pipes is uniform. The heater with the same volume obtains greater wind speed, accelerates space convection and increases the efficiency of space heating.

To solve the above technical problems, the present invention adopts the following technical solution:

An energy-saving and environment-friendly double-row air duct heater, comprising a bottom plate which is provided with a shell, wherein a motor and fan blades are arranged on one end in the shell; the upper part of the shell is provided with a control device; a heating component used with the fan blades is arranged on the other end in the shell; an air inlet is formed at the rear end of the shell correspondingly to the fan blades; an air outlet is formed at the front end of the shell correspondingly to the heating component; the heating component includes an air volume drainage device arranged in the middle; two groups of electric heating pipes are arranged on both sides of the air volume drainage device; each group of electric heating pipes is composed of a plurality of vertically arranged electric heating pipes; and an air guiding passage is formed between two adjacent electric heating pipes.

Preferably, an air outlet space is reserved between the air volume drainage device and the air outlet; the air volume drainage device includes two vertical baffle plates with upper ends connected with the top of the shell and lower ends connected with the bottom plate; one end of the two vertical baffle plates, corresponding to an air delivery component, is obliquely provided with vertical guiding plates; and one end of two vertical guiding plates is respectively connected with the two vertical baffle plates, and the other end is mutually connected to form a triangle.

Preferably, a heat insulating plate is arranged between the shell and the electric heating pipes; heat insulating tilting plates are arranged on both ends of the heat insulating plate which tilts to the shell; and the heat insulating plate, the heat insulating tilting plates, and the vertical baffle plates and the vertical guiding plates of the air volume drainage device form a horn-shaped air inlet and a horn-shaped air outlet.

Preferably, the two groups of electric heating pipes respectively include at least three columns of electric heating pipes; six air guiding passages are arranged among the three columns of electric heating pipes and among the electric heating pipes on both sides and the shell and the air volume drainage device; hot wind of the six air guiding passages is mixed and then finally delivered to the air outlet; and four electric heating pipe fixing holding climbers for ensuring perpendicularity and parallelism of the electric heating pipes are uniformly distributed below the electric heating pipes.

Preferably, the area from the air guiding passage formed by two groups of electric heating pipes to the air outlet is gradually decreased; the air outlet is provided with an air guiding cover with a circular necking structure; an air guiding sheet is arranged in the air guiding cover; an air guiding sheet shutter connecting and fixing sheet is arranged at the outer edge of the air guiding cover; and the air guiding sheet shutter connecting and fixing sheet is provided with an upward and downward shutter handle device.

Preferably, a section of each electric heating pipe has an arc structure that is gradually bent towards the air volume drainage device from the air inlet to the air outlet.

Preferably, an air outlet mesh is arranged between the air outlet and the electric heating pipes; the air outlet mesh is connected into a plurality of air outlet holes by a plurality of crisscross connected connecting rods; and a temperature control probe electrically connected with the control device is arranged close to the air outlet mesh in the bottom plate.

Preferably, the bottom plate is provided with an air inlet net used with the air inlet.

The present invention has the beneficial effects: the present invention includes a bottom plate which is provided with a shell, wherein a motor and fan blades are arranged on one end in the shell; the upper part of the shell is provided with a control device; a heating component used with the fan blades is arranged on the other end in the shell; an air inlet is formed at the rear end of the shell correspondingly to the fan blades; an air outlet is formed at the front end of the shell correspondingly to the heating component; the heating component includes an air volume drainage device arranged in the middle; two groups of electric heating pipes are arranged on both sides of the air volume drainage device; each group of electric heating pipes is composed of a plurality of vertically arranged electric heating pipes; and an air guiding passage is formed between two adjacent electric heating pipes. The present invention adds the air volume drainage device on the prior art. The middle sectional area of an air duct is decreased, and wind is compressed on both sides. Wind speed is increased and heat on the surfaces of the electric heating pipes is fully taken away. The electric heating pipes are arranged on both sides of the air volume drainage device, so that the wind in the air duct comes into full contact with the electric heating pipes, thereby effectively solving the thermal efficiency problem of space heating and increasing the thermal efficiency. The temperature of the surfaces of the electric heating pipes is uniform. The heater with the same volume obtains greater wind speed, accelerates space convection and increases the efficiency of space heating.

REFERENCE SIGNS

Figure 1:
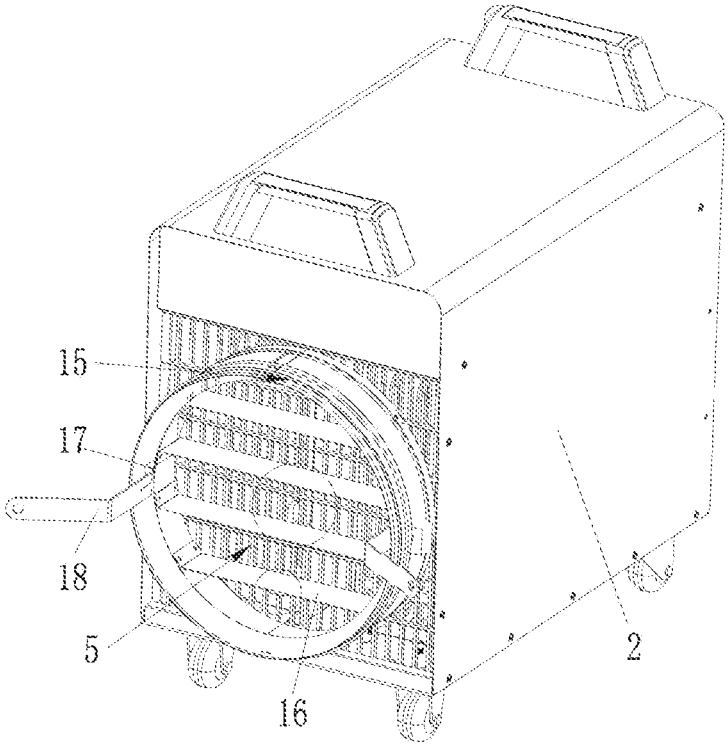
FIG. 1 is a structural schematic diagram of the present invention.
Figure 2:
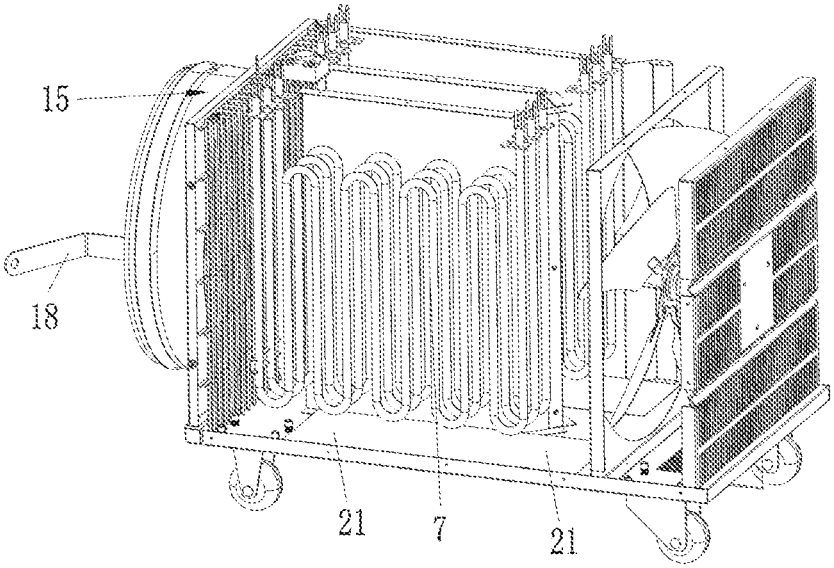
FIG. 2 is a structural schematic diagram of the present invention without a shell and a heat insulating plate.

1—bottom plate 2—shell 3—motor
4—fan blade 5—air outlet 6—air volume drainage device
7—electric heating pipe 8—air guiding passage 9—vertical baffle plate
10—vertical guiding plate 11—air outlet mesh 12—air outlet hole
13—heat insulating plate 14—heat insulating tilting plate 15—air guiding cover
16—air guiding sheet 17—air guiding sheet shutter connecting and fixing sheet
18—upward and downward shutter handle device 161—ground limit bump
19—temperature probe 20—air inlet net 21—electric heating pipe fixing holding climber.

DETAILED DESCRIPTION

The present invention is further described below in detail in combination with the drawings and embodiments.

As shown in FIG. 1 to FIG. 5, an energy-saving and environment-friendly double-row air duct heater includes a bottom plate 1 which is provided with a shell 2, wherein a motor 3 and fan blades 4 are arranged on one end in the shell 2; the upper part of the shell is provided with a control device; a heating component used with the fan blades 4 is arranged on the other end in the shell 2; an air inlet is formed at the rear end of the shell 2 correspondingly to the fan blades 4; an air outlet 5 is formed at the front end of the shell 2 correspondingly to the heating component; the heating component includes an air volume drainage device 6 arranged in the middle; two groups of electric heating pipes 7 are arranged on both sides of the air volume drainage device 6; each group of electric heating pipes 7 is composed of a plurality of electric heating pipes 7 arranged in parallel; and an air guiding passage 8 is formed between two adjacent electric heating pipes 7. The present invention adds the air volume drainage device 6 on the prior art. The middle sectional area of an air duct is decreased, and wind is compressed on both sides. Wind speed is increased and heat on the surfaces of the electric heating pipes 7 is fully taken away. The electric heating pipes 7 are arranged on both sides of the air volume drainage device 6. Three preferred electric heating pipes 7 are respectively arranged on both sides of the air volume drainage device 6. Corresponding wind speeds can be set according to the electric heating pipes 7 with different powers, and the electric heating pipes 7 can be in point-to-point proportion to the wind speeds. Thus, the wind in the air duct comes into full contact with the electric heating pipes 7, thereby effectively solving the thermal efficiency problem of space heating and increasing the thermal efficiency. The temperature of the surfaces of the electric heating pipes 7 is more uniform. The heater with the same volume obtains greater wind speed, accelerates space convection and increases the efficiency of space heating.

As shown in FIG. 2 to FIG. 5, in the present embodiment, an air outlet space is reserved between the air volume drainage device 6 and the air outlet 5; the air volume drainage device 6 includes two vertical baffle plates 9 with upper ends connected with the top of the shell 2 and lower ends connected with the bottom plate 1; one end of the two vertical baffle plates 9, corresponding to an air delivery component, is obliquely provided with vertical guiding plates 10; and one end of two vertical guiding plates 10 is respectively connected with the two vertical baffle plates 9, and the other end is mutually connected to form a triangle. The triangular vertical guiding plates 10 directly face the fan blades 4. Such triangular vertical guiding plates 10 and the vertical baffle plates 9 can guide the wind blown by the fan blades 4 to the electric heating pipes 7 on both sides of the air volume drainage device 6; the wind in the air duct comes into full contact with the electric heating pipes 7; the wind is compressed on both sides; wind speed is increased and heat on the surfaces of the electric heating pipes 7 is fully taken away, thereby increasing the efficiency of space heating.

As shown in FIG. 2 to FIG. 5, in the present embodiment, a heat insulating plate 13 is arranged between the shell 2 and the electric heating pipes 7; heat insulating tilting plates 14 are arranged on both ends of the heat insulating plate 13 which tilts to the shell 2; and the heat insulating plate 13, the heat insulating tilting plates 14, and the vertical baffle plates 9 and the vertical guiding plates 10 of the air volume drainage device 6 form a horn-shaped air inlet and a horn-shaped air outlet. The horn-shaped air inlet and the horn-shaped air outlet can increase air inlet volume and air outlet volume.

As shown in FIG. 2 to FIG. 5, in the present embodiment, the two groups of electric heating pipes 7 respectively include at least three columns of electric heating pipes 7; six air guiding passages 8 are arranged among the three columns of electric heating pipes 7 and among the electric heating pipes 7 on both sides and the shell 2 and the air volume drainage device 6; and hot wind of the six air guiding passages 8 is mixed and then finally delivered to the air outlet 5. During use, the motor 3 drives the fan blades 4 to blow the wind into the six air guiding passages 8 on both sides of the air volume drainage device 6. The hot wind is compressed and then blown out by the air outlet 5. Thus, the heater with the same volume obtains greater wind speed, accelerates space convection and increases the efficiency of space heating. Four electric heating pipe fixing holding climbers 21 for ensuring perpendicularity and parallelism of the electric heating pipes 7 are uniformly distributed below the electric heating pipes 7. The perpendicularity and the parallelism of the electric heating pipes 7 can be limited through the electric heating pipe fixing holding climbers 21 to further ensure uniform wind in a wind cavity and reduce wind outlet resistance.

As shown in FIG. 2 to FIG. 6, in the present embodiment, the area from the air guiding passage 8 formed by two groups of electric heating pipes 7 to the air outlet 5 is gradually decreased; and the air outlet 5 is provided with an air guiding cover 15 with a circular necking structure. The necking air guiding cover 15 of the air outlet 5 enables the wind to change to return for conducting secondary heating. Thus, the wind at the air outlet 5 is uniformly blown out repeatedly to play the effect of repeated heating. An air guiding sheet 16 is arranged in the air guiding cover 15; a ground limit bump 161 is arranged on the air guiding sheet 16 at the lowest end of the air guiding cover 15. The air guiding sheet 16 is fixed with the ground limit bump 161, so that the air guiding sheet 16 cannot swing downwards. The hot wind is directly blown out from the air outlet 5 to prevent the hot wind from being blown to the ground, effectively prevent terrestrial heat and satisfy safety standards of the heater. An air guiding sheet shutter connecting and fixing sheet 17 is arranged at the outer edge of the air guiding cover 15; and the air guiding sheet shutter connecting and fixing sheet 17 is provided with an upward and downward shutter handle device 18 used for loading and unloading the air duct. The upward and downward shutter handle device 18 is convenient for installing an extended air duct on the air guiding cover 15.

As shown in FIG. 2 to FIG. 5, in the present embodiment, a section of each electric heating pipe 7 has an arc structure that is gradually bent towards the air volume drainage device 6 from the air inlet to the air outlet 5. The present invention changes the existing horizontal-row type electric heating pipes 7 into straight-row type to allow the wind to directly flow, so as to reduce wind resistance on large area.

Figure 3:
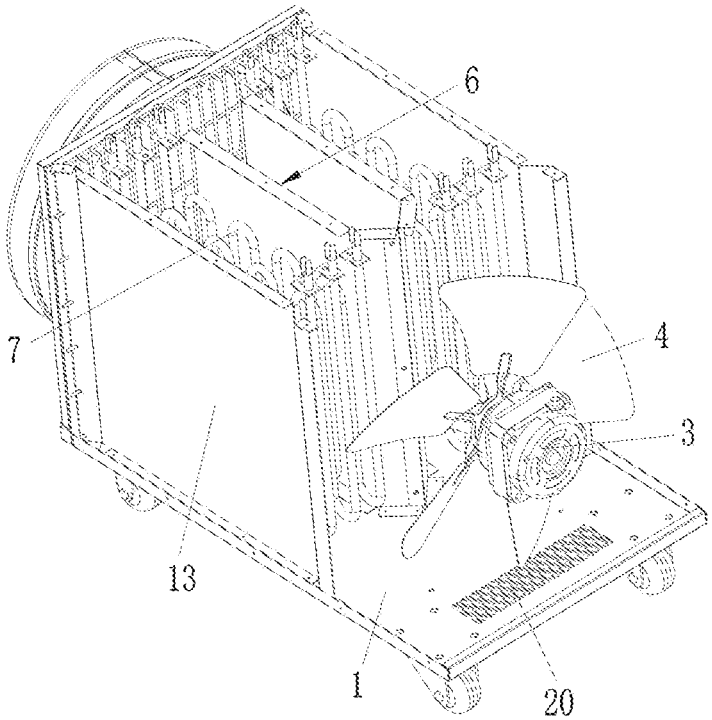
FIG. 3 is a structural schematic diagram of the present invention without a shell.

As shown in FIG. 3, in the present embodiment, an air outlet mesh 11 is arranged between the air outlet 5 and the electric heating pipes 7; the air outlet mesh 11 is connected into a plurality of air outlet holes 12 by a plurality of crisscross connected connecting rods; and the air outlet holes 12 may be quadrangular or circular as long as the compressed hot wind can be quickly and uniformly blown out. A temperature control probe 19 electrically connected with the control device is arranged close to the air outlet mesh in the bottom plate 1. The temperature control probe 19 can accurately detect the temperature of the air inlet and the air outlet under the influence of outside temperature, and can display the temperature by the control device.

Figure 4:
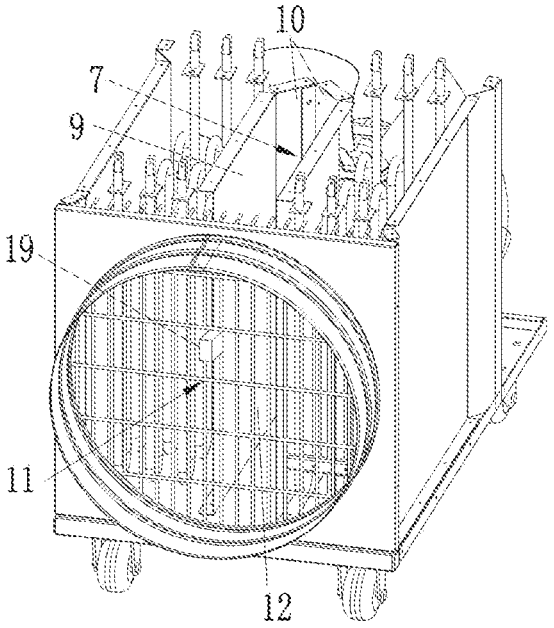
FIG. 4 is a structural schematic diagram of the present invention without a shell from another point of view.
Figure 5:
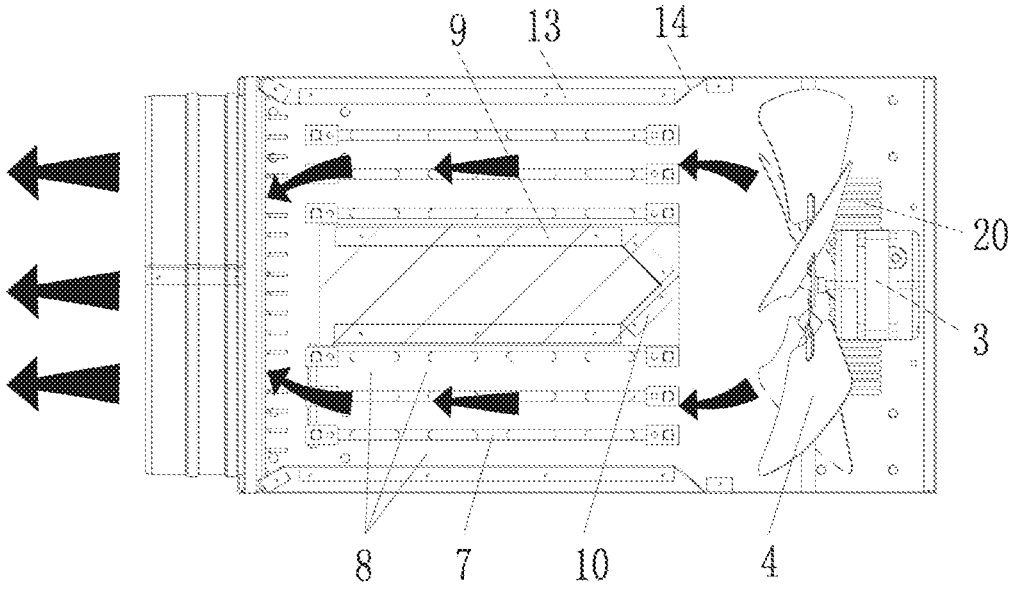
FIG. 5 is a sectional view of the present invention.
Figure 6:
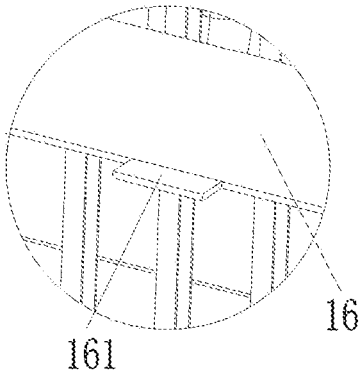
FIG. 6 is a structural schematic diagram of an air guiding sheet in the present invention.

As shown in FIG. 4, in the present embodiment, the bottom plate 1 is provided with an air inlet net used with the air inlet. The air inlet net 20 aids the wind to enter the rear side of the fan blades 4 from the bottom plate 1.

The above contents are only preferred embodiments of the present invention. For those ordinary skilled in the art, specific embodiments and the application scope may be changed in accordance with the thought of the present invention. The contents of the description shall not be interpreted as a limitation to the present invention.

What is claimed is:

1. An energy-saving and environment-friendly double-row air duct heater, comprising:

a bottom plate provided with a shell, wherein a motor and fan blades are arranged on one end in the shell; a heating component used with the fan blades is arranged on an other end in the shell; an air inlet is formed at a rear end of the shell correspondingly to the fan blades; an air outlet is formed at a front end of the shell correspondingly to the heating component; the heating component comprises an air volume drainage device arranged in the middle; two groups of electric heating pipes for reducing wind resistance are arranged on both sides of the air volume drainage device; each group of electric heating pipes is composed of a plurality of vertically arranged electric heating pipes; and an air guiding passage is formed between two adjacent electric heating pipes;

an air outlet space is reserved between the air volume drainage device and the air outlet the air volume drainage device comprises two vertical baffle plates with upper ends connected with a top of the shell and lower ends connected with the bottom plate; one end of the two vertical baffle plates, corresponding to an air delivery component, is obliquely provided with vertical guiding plates; and one end of two vertical guiding plates is respectively connected with the two vertical baffle plates, and an other end is mutually connected to form a triangle.

2. The energy-saving and environment-friendly double-row air duct heater of claim 1, wherein a plurality of heat insulating plates are arranged between the shell and the two groups of electric heating pipes; a plurality of heat insulating tilting plates are arranged on both ends of the plurality of heat insulating plates which tilt to the shell; and the plurality of heat insulating plates, the plurality of heat insulating tilting plates, and the vertical baffle plates and the vertical guiding plates of the air volume drainage device form a horn-shaped air inlet and a horn-shaped air outlet.

3. The energy-saving and environment-friendly double-row air duct heater of claim 1, wherein the two groups of electric heating pipes respectively comprise at least three columns of electric heating pipes; six air guiding passages are arranged among the three columns of electric heating pipes and among the electric heating pipes on both sides and the shell and the air volume drainage device; hot wind of the six air guiding passages is mixed and then finally delivered to the air outlet; and four electric heating pipe fixing holding climbers for ensuring perpendicularity and parallelism of the electric heating pipes are uniformly distributed below the electric heating pipes.

4. The energy-saving and environment-friendly double-row air duct heater of claim 1, wherein an area from the six air guiding passages formed by two groups of electric heating pipes to the air outlet is gradually decreased; the air outlet is provided with an air guiding cover with a circular necking structure; an air guiding sheet is arranged in the air guiding cover; an air guiding sheet shutter connecting and fixing sheet is arranged at the outer edge of the air guiding cover; and the air guiding sheet shutter connecting and fixing sheet is provided with an upward and downward shutter handle device.

5. The energy-saving and environment-friendly double-row air duct heater of claim 1, wherein a section of each electric heating pipe has an arc structure that is gradually bent towards the air volume drainage device from the air inlet to the air outlet.

6. The energy-saving and environment-friendly double-row air duct heater of claim 2, wherein an air outlet mesh is arranged between the air outlet and the two groups of electric heating pipes; the air outlet mesh is connected into a plurality of air outlet holes by a plurality of crisscross connected connecting rods; and a temperature control probe is arranged close to the air outlet mesh in the bottom plate.

7. The energy-saving and environment-friendly double-row air duct heater of claim 1, wherein the bottom plate is provided with an air inlet net used with the air inlet.

* * * * *